United States Patent [19]

Beckhardt et al.

[11] 4,252,249

[45] Feb. 24, 1981

[54] LID FOR PUMP ASSEMBLY

[75] Inventors: William H. Beckhardt, Corona Del Mar; Richard O. Carlson, Yorba Linda; William N. Rowley, Palos Verdes Estates; Gordon F. Ehret, Alhambra; Dani Setjo, San Gabriel, all of Calif.

[73] Assignee: The Marley-Wylain Company, Mission, Kans.

[21] Appl. No.: 118,924

[22] Filed: Feb. 6, 1980

[51] Int. Cl.[3] ..... B65D 17/52; B65D 43/26

[52] U.S. Cl. ..... 220/284; 220/94 A; 220/288; 215/302

[58] Field of Search ..... 220/284, 94 A, 288; 215/302, 10; 81/3.4; 138/89

[56] References Cited

U.S. PATENT DOCUMENTS

| | | | |
|---|---|---|---|
| 2,408,233 | 9/1946 | Smith | 220/284 |
| 3,334,772 | 8/1967 | Henderson | 220/284 |

*Primary Examiner*—George T. Hall

*Attorney, Agent, or Firm*—Lane, Aitken, Ziems, Kice & Kananen

[57] ABSTRACT

A threaded lid for closing the opening in a pump housing having a body portion and a gripping formation defined by a ridge on the body portion having a central portion and projections extending beyond the central portion. A juncture between the central portion and each of the projections varies gradually from a rounded angle at one terminus of the juncture to a gently sloping ramp at the other terminus of the juncture, so that a simple elongated tool such as a stick may be placed between the projections of the gripping formation and rotated to loosen the lid, but not to tighten it. Furthermore, the mildly curved S-shape provides surfaces which conform to the hand to enable substantial manual loosening force to be applied comfortably to the lid, whereas the surfaces of the gripping formation engaged by the hand to tighten the lid are not conducive to the application of a substantial amount of manual force.

22 Claims, 3 Drawing Figures

LID FOR PUMP ASSEMBLY

BACKGROUND OF THE INVENTION

This invention relates to a lid for a fluid pump assembly, and more particularly, to a threaded lid having a gripping formation by which the lid may be turned relative to the pump housing for easy removal and replacement.

The housings of swimming pool pump assemblies customarily include a portion defining a casing for a coarse strainer basket. The strainer basket is designed to remove foreign objects such as sticks, leaves, hair, etc., from the circulating pool water to protect the impeller of the pump and to prevent such objects from reaching a filter through which the pool water is passed for removal of impurities. The strainer basket casing contains a threaded opening to allow the strainer basket to be removed and emptied upon removal and replacement of the lid.

However, problems arise with respect to the removal of the lid prior to the emptying of the strainer basket. For example, although the removal and emptying of the strainer basket is a manual procedure which ordinarily can be performed easily by an individual swimming pool owner, the lids on the strainer basket casings often become fixed in place or stuck, thus inviting the use of a tool such as a large pair of pliers or a hammer to loosen the lid. The use of such tools has a tendency to crack or break the gripping formation, as well as other parts of the lid.

The resistance to unthreading rotation of such lids is due to a number of factors. Individual swimming pool owners tend to over-tighten the lid when replacing it, usually by using the aforementioned tool. Furthermore, small particles such as sand and fragments of leaves and other vegetation become lodged in the mating surfaces of the threads of the lid and the strainer basket casing opening as the water carrying the particles flows through the strainer basket casing. In addition, variations in temperature result in expansion and contraction of the lid relative to the opening of the strainer basket casing, thereby causing the threads to bind. Moreover, some materials of which the lid may be formed, such as plastics, are subject to swelling and deterioration upon exposure to chemicals, such as chlorine, present in the recirculated pool water.

SUMMARY OF THE INVENTION

It is therefore an object of the present invention to provide a lid for a pump assembly which lends itself to removal by the use of a simple elongated tool such as a stick or small branch and eliminates the need for large, awkward tools such as pliers and hammers, which have a tendency to damage the lid.

It is a further object of the present invention to provide a lid for a pump assembly which provides structure for preventing the use of a simple elongated tool, such as that described above, to over-tighten the lid upon replacement.

It is a still further object of the present invention to provide a lid for a pump assembly which maximizes the moment arm at which force can be applied to the lid by an elongated tool and minimizes the stress that the tool will impart to the lid.

It is an additional object of the present invention to provide a lid for a pump assembly which has a gripping formation which facilitates the application of a large manual force to loosen the lid, and inhibits the application of a large manual force to tighten the lid.

Toward the fulfillment of these and other objects, the lid of the present invention comprises a one piece screw-threaded closure member having a body portion in the shape of a shallow dome and an integral gripping formation formed thereon, the gripping formation being of a configuration to define a ridge extending across substantially the entire body portion and having the shape of a mildly curving S. The ridge also has a substantially flat central portion extending between a pair of projecting end portions. A shaped juncture is provided between the central portion and each end projection. The juncture varies from a rounded angle at one terminus of the juncture to a gently sloping ramp extending from the central portion to the top surface of the projection at the opposite terminus of the juncture. Each rounded angle lies at the terminus of the juncture disposed on the side of the ridge facing the direction in which the lid is tightened. Each ramp lies at the terminus of the juncture disposed on the side of the ridge facing the direction in which the lid is loosened.

Consequently, a simple elongated tool placed on the central portion of the ridge and rotated about the thread axis of the lid in the direction in which the lid is tightened will engage the ramps and will be cammed upwardly beyond the projections, thus, preventing the tool from imparting a force to the ridge in the direction in which the lid is tightened. In contrast, when the tool is rotated on the central portion about the thread axis in the direction in which the lid is loosened, the rounded angle will permit the tool to engage a face of each projection which is substantially perpendicular to the body portion, thereby allowing the tool to impart to the ridge a force in the form of a couple and, consequently, to loosen the lid.

Moreover, the S-shape allows the perpendicular faces to lie in planes which are spaced from and substantially parallel to one another, which results in the elongated tool acting at a maximum moment arm and minimum stress being developed in the projections. Furthermore, the S-shaped ridge has a pair of concave inner surfaces providing pockets for portions of a hand loosening the lid, and a pair of convex outer surfaces for preventing the application of substantial force by a hand tightening the lid.

The lid may be constructed of any suitable material, such as metal or plastic. However, it is preferable to form the lid in one piece from a transparent plastic material. Such a material is lightweight and inexpensive to produce, and it permits visual inspection of the strainer basket in place in the pump housing to determine if a cleaning is required, thereby eliminating the need for unnecessary removals of the lid.

DESCRIPTION OF THE PREFERRED EMBODIMENT

Figure 1:
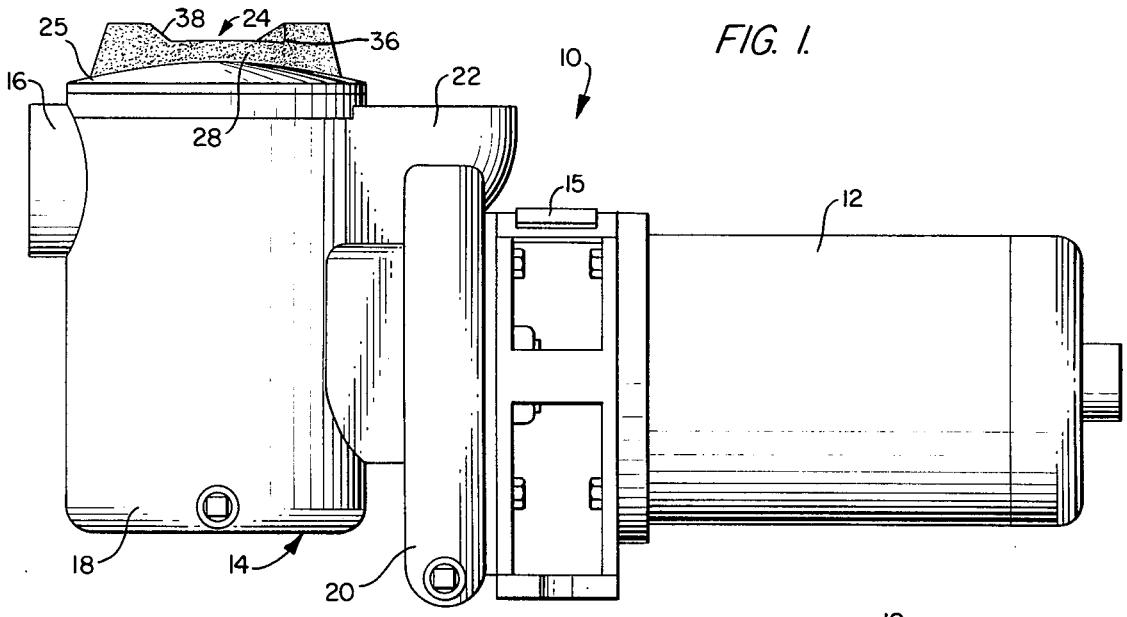
FIG. 1 is a front elevational view of a pump assembly having the lid of the present invention secured in place thereon.

In FIG. 1, the reference numeral 10 designates a pump assembly including an electric motor 12 having an output shaft (not shown) and adapted to operate in a conventional manner. A pump housing 14 is mounted to the motor 12 by a bracket 15 and is provided with an inlet 16, a strainer basket casing 18 and a volute, or pumping chamber 20 having an outlet 22. A lid 24 is provided on the top of the strainer basket casing 18, it being understood that a strainer basket or other type filter device can be provided in the casing 18. The lid may be constructed of any suitable material, such as metal or plastic, but it is preferably formed in one piece from a transparent plastic material so that the build-up of foreign matter in the strainer basket can be viewed with the lid in place.

Figure 2:
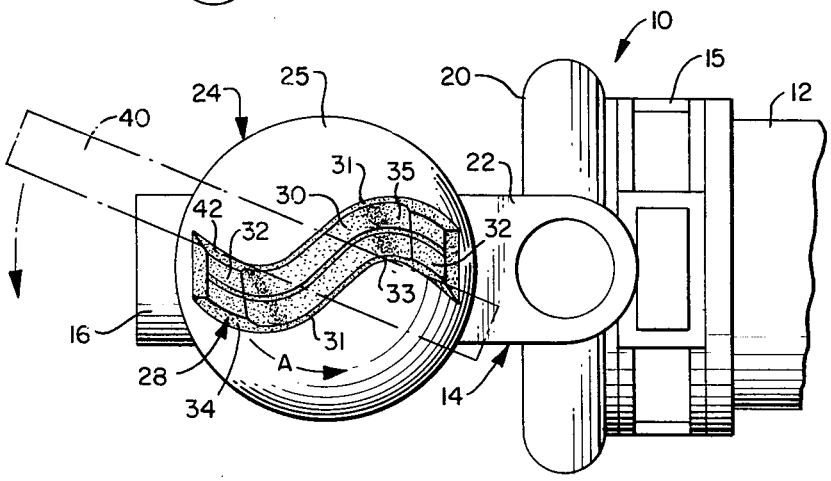
FIG. 2 is a partial plan view of the pump assembly and lid of FIG. 1, with a simple elongated tool shown in phantom in operative postion on the lid for loosening the lid.
Figure 3:
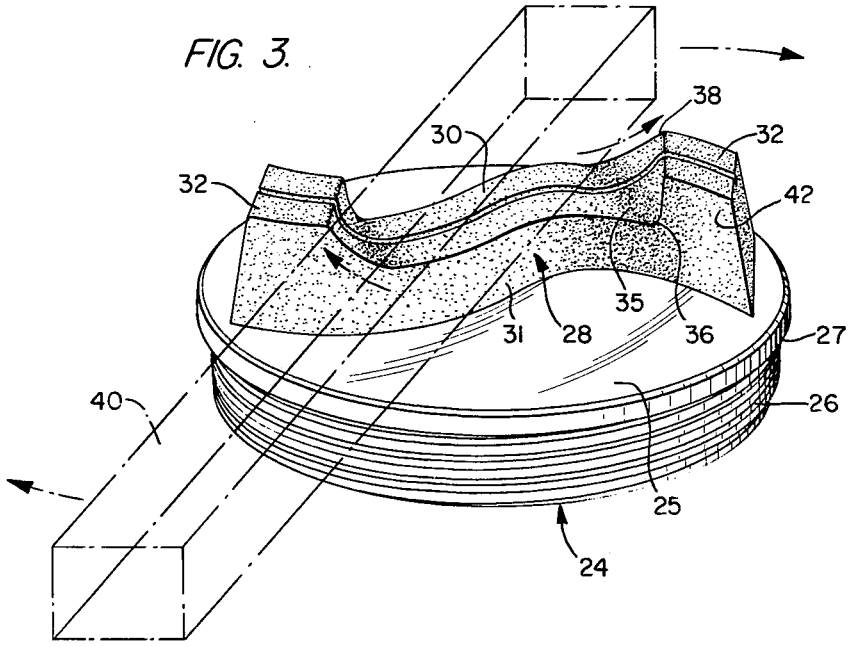
FIG. 3 is a perspective view of the pump assembly lid of the present invention, with the simple elongated tool shown in phantom in a position for attempting to tighten the lid.

As shown in FIGS. 2 and 3 of the drawings, which depict the above-mentioned lid 24 in greater detail, the lid 24 includes a body portion 25 in the shape of a shallow dome, a depending flange 26 having screw threads formed thereon for engagement with complementary screw threads formed around the top of the strainer basket casing 18, and a gripping formation integrally formed on the top of the lid 24 to enable the lid 24 to be secured to and removed from the strainer basket casing 18. The depending flange 26 is spaced inward from the periphery of the body portion 25, thereby defining a peripherally extending flange 27.

The gripping formation is defined by a ridge 28 integrally formed on the top of the body portion 25, extending across substantially the entire body portion 25 and having the shape of a mildly curving S. The ridge 28 includes a substantially flat central portion 30, sides 31 extending from the body portion 25 to the central portion 30, and projections 32 disposed at the ends of the ridge 28 and extending beyond the central portion 30. Each side 31 defines a concave inner surface 33 and a convex outer surface 34. The intersection of the central portion 30 with each of the projections 32 defines a shaped juncture 35 which varies from a rounded approximately 90° angle 36 at one terminus of the juncture 35 to a gently sloping ramp 38 extending from the central portion 30 to the top of the projection 32 at the opposite terminus of the juncture 35. For each juncture 35, the rounded angle 36 lies at the terminus of the juncture 35 on the side 31 of the ridge 28 facing the rotational direction in which the lid 24 is tightened, and the gently sloping ramp 38 lies at the terminus of the juncture 35 on the side 31 of the ridge 28 facing the rotational direction in which the lid is loosened, which is shown by the arrow A in FIG. 2.

The rounding of the angle 36, as opposed to forming a sharp corner, reduces the possibility of cracking or breaking taking place at the angle 36 due to the development of stress concentrations there upon the application of the large forces associated with the use of tools. It also permits easier molding or casting or the lid 28.

An elongated tool 40, such as a bar or stick, may be placed flat on the central portion 30 of the ridge 28 and pivoted around the thread axis until portions of the tool 40 engage a pair of faces 42, which are substantially perpendicular to the body portion 25 and are defined by the sides of the projections 32 lying adjacent to the rounded angle 36 and facing in the direction in which the lid is tightened.

Such engagement is possible because the rounded angle 36 represents an absence of material as opposed to the presence of material such as a ramp, which would prevent such engagement, as the ramps 38 do at the opposite terminus of the juncture 35. Thus, the tool 40 is able to lie on the central portion 30 and engage the perpendicular faces 42.

Once the elongated tool 40 is engaged with the perpendicular faces 42, additional pivotal movement of the tool 40 results in the movement of the lid 28 in a loosening direction by transmitting a couple to the lid 24 through its ridge 28. Thus, the elongated tool 40 can be used as a lever to increase the force that can be applied by an individual swimming pool owner to loosen the lid 24. Of course, it can be seen that the force that can be applied by the owner increases proportionally to the length of the elongated tool 40 used.

The perpendicular faces 42 lie in planes which are spaced and are substantially parallel, so that elongated tools which are thinner than the spacing between the parallel planes, which may be about two inches, will engage the perpendicular faces 42 at their radially outermost edges, thus maximizing the moment arm through which the applied force acts. The moment arm is the perpendicular distance from the thread axis to the line of action of the applied force, wherein the line of action is the extended line along which the applied force acts.

For a ridge configuration in which there were no space between the planes in which the perpendicular faces lie, an elongated tool would engage the perpendicular faces at their radially innermost edges, thus significantly reducing the moment arm through which the applied force acts. This reduction in moment arm would have the effect of reducing the loosening torque which would be applied to the lid for a given amount of force applied to an elongated tool by a pool owner, and increasing the stress to which the perpendicular faces would be subjected in order to obtain a given loosening torque.

Elongated tools which are thicker than the space between the parallel planes containing the perpendicular faces 42, will engage the radially innermost edges of the perpendicular faces 42. However, these thicker elongated tools engage the innermost edges so that the applied force has a greater component in the lid loosening direction than would a force applied to corresponding perpendicular faces which did not lie in spaced planes.

The projections 32 have a width equal to the width of the ridge 28, so that a substantial mass of material is provided to receive the stress imparted to the perpendicular faces 42 by the elongated tool 40.

The central portion 30 serves as a support for maintaining the elongated tool 40 above the shallow dome-shaped body portion 25 and well above the rest of the pump assembly 10, especially inlet 16, so that clearance is provided between the elongated tool 40 and the pump assembly for the hand or hands of a swimming pool owner, enabling him to grip the elongated tool 40 and loosen the lid 24.

By the provision of the gently sloping ramps 38, the elongated tool 40 cannot be used to tighten the lid 24. The ramps 38 will not allow the elongated tool 40 to engage faces of the projections 32 or any other portion of the ridge 26 which would coact with the elongated tool 40 to tighten the lid 24. Instead, the gentle sloping of the ramps 38 cams the elongated tool 40 upward over the top of the projections 32 so that the elongated tool 40 comes out of contact with the central portion 30 and fails to transmit any appreciable force to the lid 24 in the direction in which the lid is tightened.

It is, therefore, seen that the structure of the lid 24 of the present invention enables a swimming pool owner to apply to the lid 24 of the pump assembly 10 substantially greater force to loosen the lid 24 by the use of an elongated tool 40 than he could be using only his hands. By the same structure, the swimming pool owner is prevented from applying more force to tighten the lid 24 using an elongated tool 40 than he could apply by using only his hands.

Furthermore, by virtue of its gentle S shape, the ridge 28 presents its concave inner surfaces 33 for engagement with a hand positioned on the ridge 28 to loosen the lid 24. The concave inner surfaces 33 define hand-conforming pockets which enable the hand to firmly grip the ridge 28 to loosen the lid 24. In contrast, the ridge 28 presents convex outer surfaces 34 for engagement with a hand positioned on the ridge 28 to tighten the lid 24. The portions of the hand engaging the convex outer surfaces 34 tend to slide down along the convex surfaces 34 either into the pockets defined by the concave surfaces 33 or off the radially outer ends of the ridge 28, thus limiting the amount of tightening force which can be applied conveniently by hand to the lid 24. Therefore, the S shape of the ridge permits more force to be applied to the lid 24 in the loosening direction by a pool owner using only his hands, than can be applied by hand in the tightening direction.

Although it is apparent from the foregoing that the present invention is well adapted for application to pump assemblies, it is understood that the scope of the present invention is not so limited, but rather extends to other container closure applications. Also, various other changes and modifications may be made without departing from the spirit and scope of the present invention as recited in the appended claims and their legal equivalent.

What is claimed is:

1. A lid comprising a body portion having means for securing the lid to an opening by rotational movement of the lid with respect to the opening, so that the lid may be tightened by rotation in one direction and loosened by rotation in the opposite direction, and gripping means secured to the body portion, said gripping means comprising a ridge having a central portion, sides extending between the body portion and the central portion, a projection extending beyond the central portion at each end of the ridge, and a juncture between the central portion and each projection and terminating at the sides of the ridge, each juncture varying from an angle at one terminus of the juncture, disposed on the side of the ridge facing the direction in which the lid is tightened to a ramp at an opposite terminus of the juncture, disposed on the side of the ridge facing the direction in which the lid is loosened, whereby an elongated tool placed flat on the central portion of the ridge and rotated about the axis of the lid in the direction in which the lid is loosened will engage the projections and impart a couple to the lid, and the same tool, when rotated in the direction in which the lid is tightened will engage the sloping ramps and be cammed upwardly over the projections by the ramps.

2. The lid of claim 1 wherein each projection includes a face substantially perpendicular to the body portion and facing the direction in which the lid is tightened, said perpendicular faces being engaged by said elongated tool when said elongated tool is rotated in the direction in which the lid is loosened.

3. The lid of claim 2 wherein the perpendicular faces lie in planes which are spaced from and substantially parallel to one another, whereby said elongated tool can lie between said perpendicular faces and engage the radially outermost edges of said perpendicular faces.

4. The lid of claim 1 wherein said ramps extend from the central portion of the ridge to the top of the projections.

5. The lid of claim 1 wherein the angle is approximately 90°.

6. The lid of claim 1 wherein the ridge extends across substantially the entire body portion.

7. The lid of claim 1 wherein said gripping means is integral with said body portion.

8. The lid of claim 1 wherein the ridge includes means for facilitating a substantial loosening force to be applied to the lid by a hand, and means for inhibiting the amount of tightening force which can be applied to the lid by a hand.

9. The lid of claim 8 wherein the means for facilitating comprise concave surfaces facing the direction in which the lid is tightened, and the means for inhibiting comprise convex surfaces facing the direction in which the lid is loosened.

10. The lid of claim 1 wherein the projections have a width substantially equal to the width of the ridge.

11. In a pump having a pump housing including an inlet, an outlet, a pumping chamber, a strainer basket casing and an opening in said strainer basket casing, and a lid for closing said opening, the improvement comprising:

the lid including a body portion having means for securing the lid to said opening by rotational movement of the lid with respect to the opening, so that the lid may be tightened by rotation in one direction and loosened by rotation in the opposite direction, and gripping means secured to the body portion, said gripping means including a ridge having a central portion, sides extending between the body portion and the central portion, a projection extending beyond the central portion at each end of the ridge, and a juncture between the central portion and each projection and terminating at the sides of the ridge, each juncture varying from an angle at one terminus of the juncture, disposed on the side of the ridge facing the direction in which the lid is tightened, to a ramp at an opposite terminus of the juncture, disposed on the side of the ridge facing the direction in which the lid is loosened, whereby an elongated tool placed flat on the central portion of the ridge and rotated about the axis of the lid in the direction in which the lid is loosened will engage the projections and impart a couple to the lid, and the same tool, when rotated in the direction in which the lid is tightened will engage the ramps and be cammed upwardly over the projections by the ramps.

12. The lid of claim 11 wherein each projection includes a face substantially perpendicular to the body portion and facing the direction in which the lid is tightened, said perpendicular faces being engaged by said elongated tool when said elongated tool is rotated in the direction in which the lid is loosened.

13. The lid of claim 12 wherein the perpendicular faces lie in planes which are spaced from an substantially parallel to one another, whereby said elongated tool can lie between said perpendicular faces and engage the radially outermost edges of said perpendicular faces.

14. The lid of claim 11 wherein said ramps extend from the central portion of the ridge to the top of the projections.

15. The lid of claim 11 wherein the angle is approximately 90°.

16. The lid of claim 11 wherein the ridge extends across substantially the entire body portion.

17. The lid of claim 11 wherein said gripping means is integral with said body portion.

18. The lid of claim 11 wherein the central portion is spaced above the body portion, whereby it supports the elongated tool above the rest of the pump assembly to provide clearance between the elongated tool and the pump assembly for the hands of someone gripping the elongated tool and loosening the lid.

19. The lid of claim 11 wherein the ridge includes means for facilitating a substantial loosening force to be applied to the lid by a hand, and means for inhibiting the amount of tightening force which can be applied to the lid by a hand.

20. The lid of claim 19 wherein the means for facilitating comprise concave surfaces facing the direction in which the lid is tightened, and the means for inhibiting comprise convex surfaces facing the direction in which the lid is loosened.

21. The lid of claim 11 wherein the projections have a width equal to the width of the ridge.

22. In a lid for a pump assembly comprising a body portion having means for securing the lid to an opening by rotational movement of the lid with respect to the opening, an S-shaped ridge secured to the body portion and having a central portion, and sides extending between the body portion and the central portion, the improvement comprising:

a projection extending beyond the central portion at each end of the ridge, and a juncture between the central portion and each projection and terminating at the sides of the ridge;

each juncture varying from an angle at one terminus of the juncture, disposed on the side of the ridge facing the direction in which the lid is tightened to a ramp at an opposite terminus of the juncture, disposed on the side of the ridge facing the direction in which the lid is loosened;

whereby an elongated tool placed flat on the central portion of the ridge and rotated about an axis of the lid in the direction in which the lid is loosened will engage the projections and impart a couple to the lid, and the same tool, when rotated in the direction in which the lid is tightened will engage sloping ramps and be cammed upwardly over the projections by the ramps.

* * * * *